US010144494B2

(12) United States Patent
Hakala et al.

(10) Patent No.: US 10,144,494 B2
(45) Date of Patent: Dec. 4, 2018

(54) ARRANGEMENT AND METHOD FOR INSTALLING PROPULSION UNIT

(71) Applicant: ABB Schweiz AG, Baden (CH)

(72) Inventors: Jani Hakala, Helsinki (FI); Kimmo Kokkila, Helsinki (FI); Petri Säkkinen, Helsinki (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/714,793

(22) Filed: Sep. 25, 2017

(65) Prior Publication Data

US 2018/0009519 A1 Jan. 11, 2018

Related U.S. Application Data

(63) Continuation of application No. PCT/EP2016/056401, filed on Mar. 23, 2016.

(30) Foreign Application Priority Data

Mar. 25, 2015 (EP) ..... 15160813

(51) Int. Cl.
*B63H 5/125* (2006.01)
*B63H 21/30* (2006.01)
(Continued)

(52) U.S. Cl.
CPC ..... *B63H 21/30* (2013.01); *B63B 9/00* (2013.01); *B63H 21/17* (2013.01); *B63H 21/36* (2013.01);
(Continued)

(58) Field of Classification Search
CPC ..... B63H 21/00; B63H 21/12; B63H 21/17; B63H 21/30; B63H 21/36; B63H 2021/00;
(Continued)

(56) References Cited

U.S. PATENT DOCUMENTS 4,036,163 A 7/1977 Pehrsson
8,926,382 B2 * 1/2015 Van Der Kam .... B63B 17/0018 440/54
(Continued)

FOREIGN PATENT DOCUMENTS

EP 0167503 A1 1/1986
JP S599220487 A 12/1984
WO 8403478 A1 9/1984

OTHER PUBLICATIONS

European Search Report, EP15160813, ABB Technology AG, dated Jan. 6, 2017, 4 pages.
(Continued)

*Primary Examiner* — Daniel V Venne
(74) *Attorney, Agent, or Firm* — J. Bruce Schelkopf; Taft Stettinius & Hollister LLP

(57) ABSTRACT

An arrangement and a method for installing a propulsion unit to a hull of a ship. The propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperture in the bottom of the hull where to the propulsion unit is to be installed. The arrangement comprises a plurality of watertight covers covering openings in the bottom of the hull and a plurality of watertight covers covering openings in the top of the upper part of the propulsion unit, wherein the arrangement comprises a removable hull-side cover covering at least the opening under it, and at least one removable propulsion unit side cover covering the opening under it and facing the opening, and the removable covers are bolted from the hull-side.

16 Claims, 9 Drawing Sheets

(51) Int. Cl.

| | |
|---|---|
| ***B63B 9/00*** | (2006.01) |
| ***B63H 21/17*** | (2006.01) |
| ***B63H 21/36*** | (2006.01) |
| ***B63H 25/42*** | (2006.01) |

(52) U.S. Cl.
CPC ..... *B63H 25/42* (2013.01); *B63B 2009/007* (2013.01); *B63B 2755/00* (2013.01); *B63H 2005/1254* (2013.01)

(58) Field of Classification Search
CPC ..... B63H 2021/12; B63H 2021/30; B63H 2021/307; B63H 25/42; B63H 2025/42
USPC ..... 440/6, 49, 53, 54, 55, 57, 61 S, 66, 67, 440/71, 73, 75, 76, 79
See application file for complete search history.

(56) References Cited

U.S. PATENT DOCUMENTS

| | | | | |
|---|---|---|---|---|
| 9,708,032 | B2 * | 7/2017 | Ruostemaa ..... | B63H 5/125 |
| 2012/0058694 | A1 | 3/2012 | Krautkramer | |

OTHER PUBLICATIONS

International Search Report and Written Opinion, PCT/EP2016/056401, ABB Technology AG, 9 pages, dated Mar. 23, 2016.

* cited by examiner

ARRANGEMENT AND METHOD FOR INSTALLING PROPULSION UNIT

FIELD

The present invention relates to an arrangement and to a method for installing a propulsion unit.

BACK ROUND

The propulsion unit that is used in an azimuthal propulsion system is connected to the hull of the ship via steering gear. When the propulsion unit is turned around its vertical axis and the direction of the propiulsion force will be deviated from the longitudinal axis of the ship and the propulsion unit steers the ship.

The azimuthal propulsion unit may be mechanical or electrical. If the azimuthal propulsion unit is mechanical, the driving unit normally locates inside the hull of the ship. The driving unit may be an electric motor or a combustion motor like diesel. The propulsion force is transmitted via mechanical gears and shafts to the propeller. If the azimuthal propulsion unit is electrical, the propulsion power is lead to the propulsion unit via electric cables or via bus bars to the electric motor that locates the propulsion unit.

The azimuthal propulsion unit is attached to the hull of the ship under the water-line of the ship. The upper part of the propulsion unit is attached to the hull watertight so that the connection allows the turning of the propulsion unit around vertical axis.

Both the mechanical and the electrical propulsion unit consists of many components that require maintenance and service actions. Some of the actions even necessitates either docking or remove of the propulsion unit in order to perform the needed operations.

The docking of the whole ship is time consuming and expensive operation and there are quite a few docks available. In case of semisubmersible rig type drilling platform docking is practically impossible. Therefore the removal and the installing of the propulsion unit under water has been a useful course of action. There are several solutions to perform the underwater installations of the propulsion unit.

Patent document U.S. Pat. No. 4,035,136 A discloses an apparatus for mounting and dismounting a submerged propeller unit to and from the hull of a ship from the outside thereof. The removable, watertight housing of the propulsion is secured over the flanged opening in the hull, whereby the propeller unit is to be received to the opening. The propeller unit is positioned in the water outside the body and raised to bring a flange thereon in registry with the flange around the opening in the hull, and the two flanges are secured together in watertight relation by fastenings put in place by tools located within the watertight housing that are operable from a location outside the housing. The propeller unit is adapted to be raised into position by cables detachably secured thereto which extend through watertight passages formed in the hull. This apparatus requires a large dome to be stored inside the hull of the ship and even in the neighbourhood of the propulsion unit. Further special equipment is needed for tightening the bolts and pressurizing the dome as well as for transferring or lifting the dome. The space inside the hull is limited and valuable.

SUMMARY

An object of the present invention is to provide an arrangement and a method so as to alleviate the above disadvantages. The object of the invention is achieved with an arrangement and a method, which are defined in the independent claims. Some embodiments are disclosed in the dependent claims.

An arrangement for installing a propulsion unit to a hull of a ship, wherein the propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperture in the bottom of the hull where to the propulsion unit is to be installed. The arrangement comprises a frame plate with openings attached to the hull to cover the aperture, a plurality of watertight covers covering openings in the frame plate and plurality of watertight covers attachable to the top of the upper part of the propulsion unit to cover an opening on the top of the upper part of the propulsion unit, wherein the arrangement comprises a removable hull-side cover covering at least one opening in the frame plate under it, and at least one removable cover attachable to the propulsion unit covering one opening under it and facing the opening in the frame, and wherein the removable covers are bolted from the hull-side.

An arrangement for installing a propulsion unit to a hull of a ship, wherein the propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperature in the bottom of the hull where to the propulsion unit is to be installed. The arrangement comprises a plurality of watertight covers covering openings in the bottom of the hull and a plurality of watertight covers covering the top of the upper part of the propulsion unit, wherein the arrangement comprises a hull-side cover covering at least one first opening under it, and at least one removable propulsion unit side cover covering a second opening under it and facing the first opening, and wherein the removable cover are bolted from the hull-side.

A method for installing a propulsion nit to a hull of a ship, wherein the propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperture in the bottom of the hull where to the propulsion unit is to be installed. The method comprises a step of attaching a frame plate with openings to the hull to cover the aperture, steps of a plurality of water-tight covers covering openings in the frame plate and of installing a plurality of watertight covers covering an opening on the top of the upper part of the propulsion unit, wherein at least one removable hull-side cover covering at least one opening in the frame is faced to at least one removable propulsion unit side cover covering the opening under it, and wherein the removable covers are bolted from the hull-side.

Big domes and lifting heavy parts inside thruster room are not needed at all in invented solution. Water tight small double flanges are used to prevent sea water ingress. In addition, steering gear frame structure is used as a watertight element in propulsion unit side. Watertight blanking flange is used as a basement of the slip ring unit. Removal of slip ring unit is not needed during propulsion unit replacement procedure installation and storage don't require any extra space in thruster room, normal maintenance space is sufficient for storage of relatively small watertight double flanges. Installation time is reduced significantly.

In addition initial cost is reduced due to smaller amount of material. Installation time and material cost is reduced.

Minimal space is needed in thruster room. No lifting of heavy components is needed leading to improved work safety.

DRAWINGS

In the following, the invention will be described in greater detail by means of some embodiments with reference to the accompanying drawings, in which FIG. 1 shows a propulsion unit;

Figure 9B:
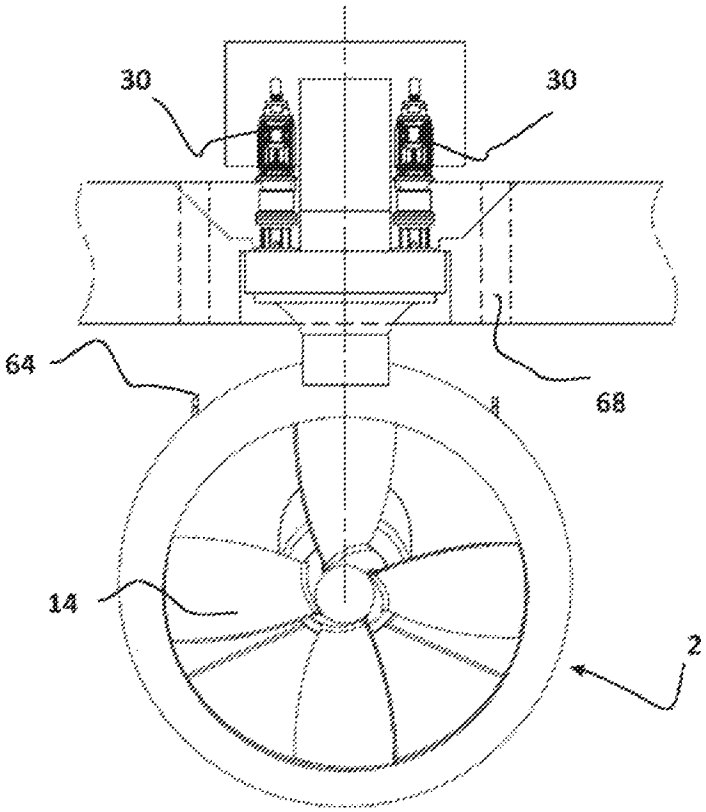
Figure 9A:
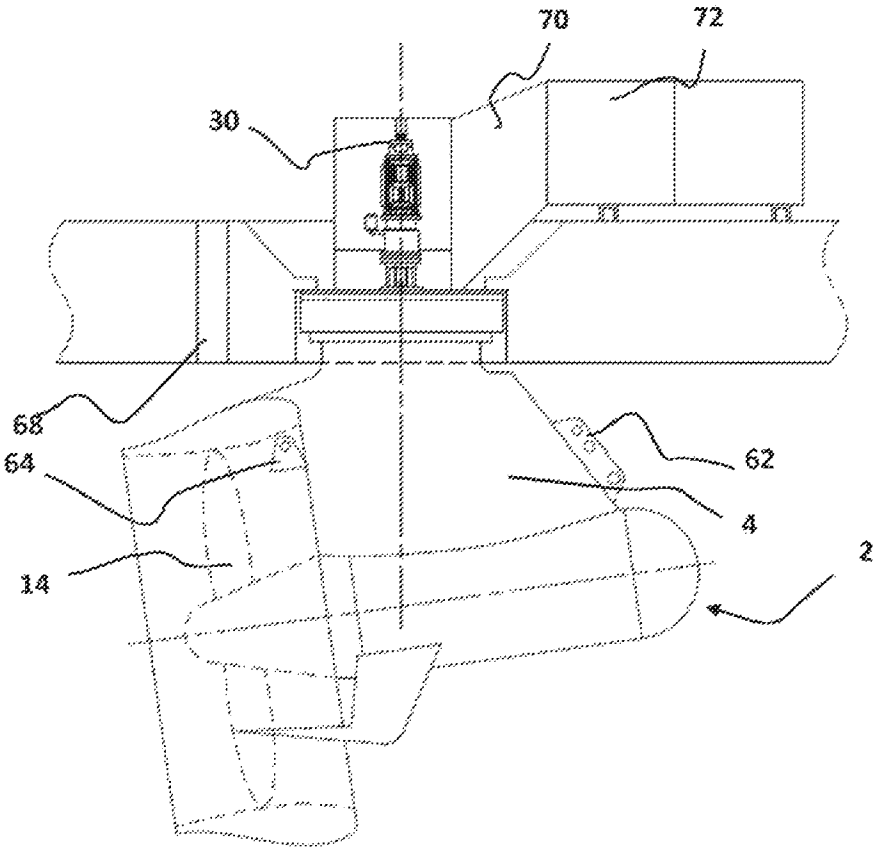

FIG. 9*a* snows a side view of an embodiment of installed propulsion unit; and FIG. 9*b* shows an axial view of an embodiment of installed propulsion unit.

DETAILED DESCRIPTION

The embodiments relate to some exemplary implementations of the invention. The presentation shows the installation of the propulsion unit phase by phase and only shows the required parts in each phase. Each part is identified with the same reference number in each Figure.

Figure 1:
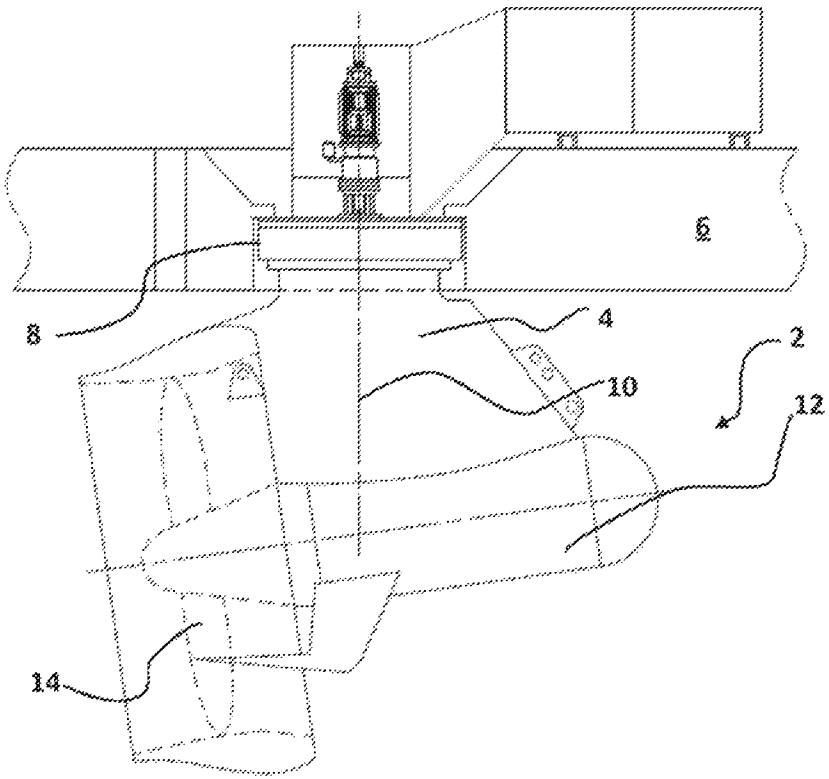
Figure 2:
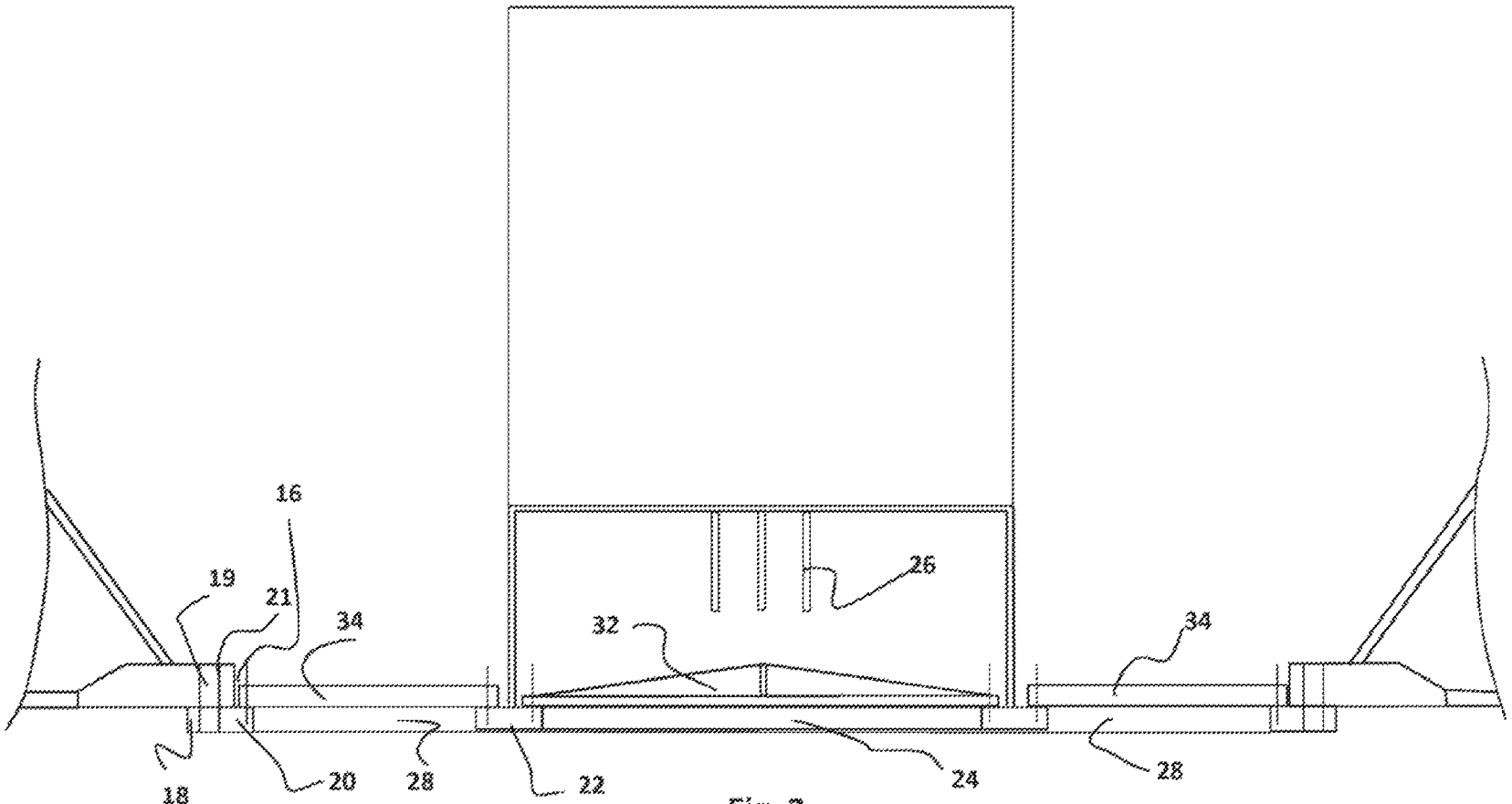
FIG. 2 shows a hull-side portion of an arrangement according to the invention.
Figure 4:
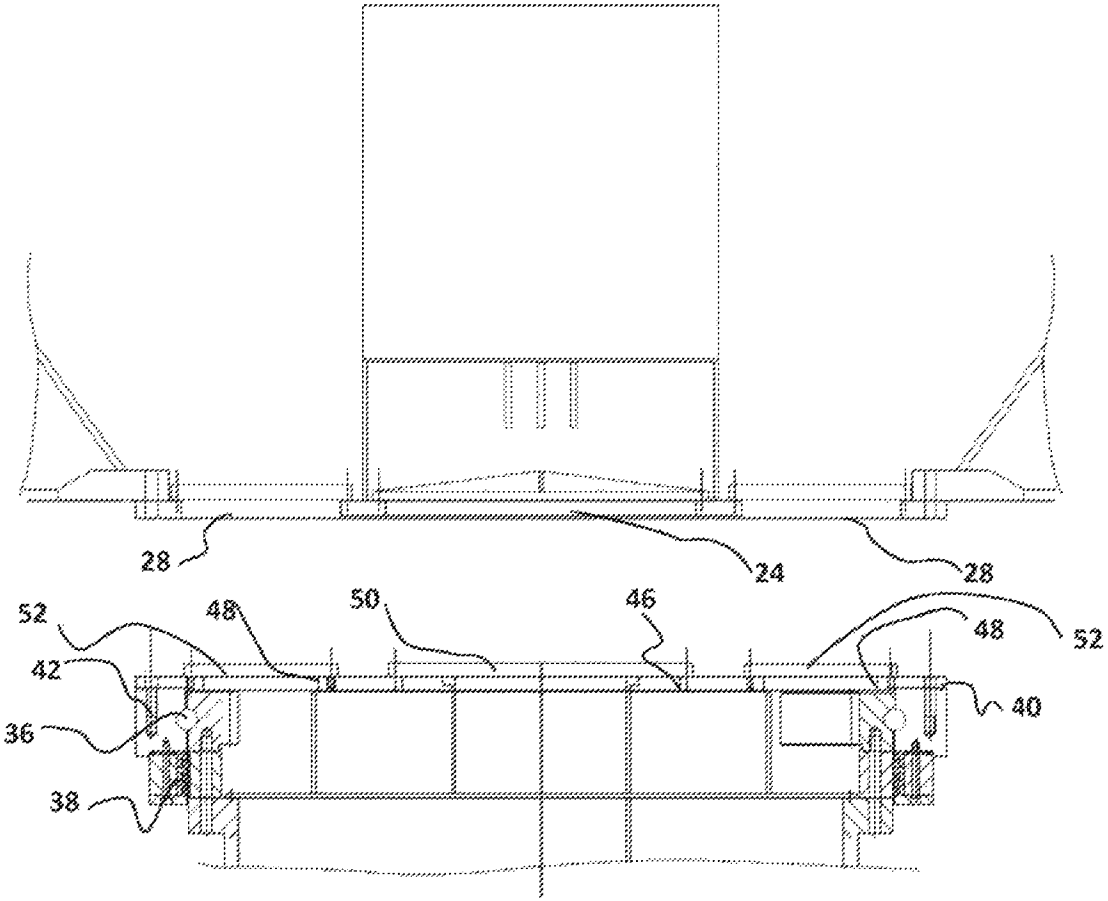
FIG. 4 shows lifting and guiding the propulsion unit portion.
Figure 5:
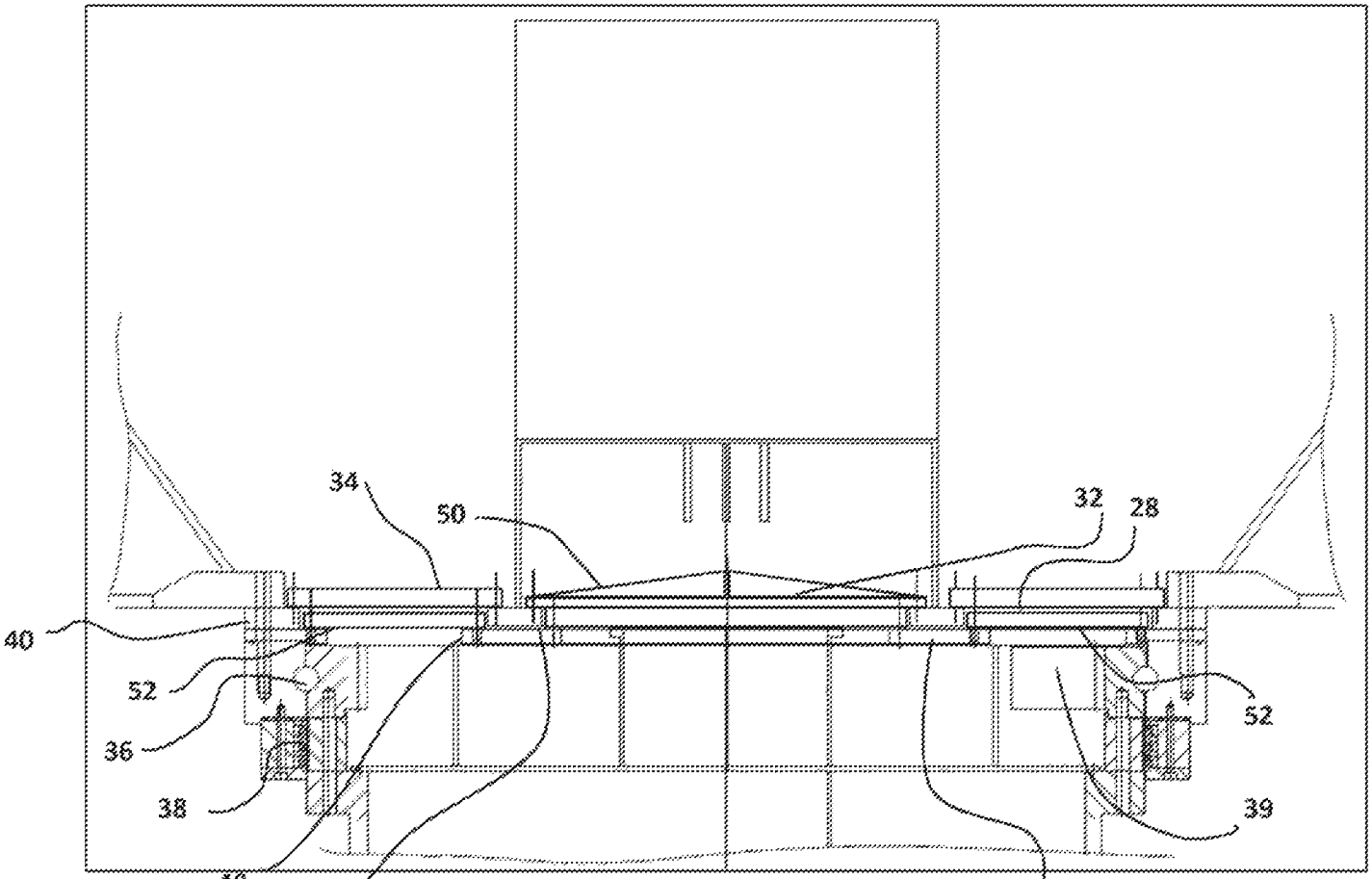
FIG. 5 shows the arrangement according to the invention ready for bolting.

FIG. 1 shows a side view of an exemplary propulsion unit, which is installed utilizing the teaching of the invention. The propulsion unit 2 comprises an upper part 4, which is attached to the hull 6 of a ship with a steering module 8. The steering module 8 allows the propulsion unit 2 to turn around the vertical axis 10 of the propulsion unit 2. The steering module 8 comprises steering motors, which turn the propulsion unit 2 via gears, bearings to support it to the null 6 and watertight seals as detailed in FIGS. 4 to 6, for example. The propulsion unit 2 further comprises a lower part 12 attached to the lowest part of the upper part 4. The lower part comprises an outer frame and an electric motor inside. The propeller 14 is attached to the shaft of the motor and protrudes from one end of the lower part 12. The propulsion unit may be realized variously well-known in the art; the propeller may be in the other end of the lower part, there may nozzle around the propeller, the electric motor may be an asynchronous or a synchronous motor, for example.

In the FIGS. 2 to 5 an exemplary embodiment of the invention is described phase by phase. The FIGS. 2 to 6 show selected parts of the whole structure in each installation phase. An aperture 16 has been formed in the bottom of the hull 6. The aperture 16 is covered by a frame plate 18, which forms the upper part of the steering module 8. The frame plate 18 is bolted or welded to the hull and it locates under the hull 6. If the frame plate 18 is bolted, short bolts with gaskets are used to avoid long protruding from the plate plane and to tighten and seal the joint. The plate 18 is preferably round and it has a plurality of openings. In the middle of the frame plate 18 there is a first opening 24 for introducing the electric cables 26 and pipes (not shown). On the outer section of the frame plate 18 there are a plurality of second openings 28 for installing steering motor assemblies 30. For one propulsion unit there is at least one steer motor and one second opening 28. In this embodiment there are two steering motors and two second openings 28, which are positioned on the opposite sides of the frame plate 18. While in the FIG. 2 two opposite second openings is shown, in practice there might be altogether four steering motors and four second openings.

The first opening 24 is covered by a first watertight cover 32, which is from the inside of the hull fixed with bolts to the frame plate 18. The second openings 28 are covered by second watertight covers 34, which are from the inside of the hull fixed with bolts to the frame plate 18. From the seaside of the hull 2 there are three openings visible, the first opening 24 blanked with the first watertight cover 32 and two second openings 28 blanked with two pieces of the second watertight covers 34. Further, the underside of frame plate and holes 21 of the bolts 19 are covered with blanking ring or blanking plate (not shown) to prevent marine fouling before propulsion unit installation. Blanking plate or blanking ring is removed just prior to propulsion unit installation. The covers 32 and 34 are installed to hull-side in order to make openings water tight and are attached to the hull 6 via frame plate 18.

Figure 3:
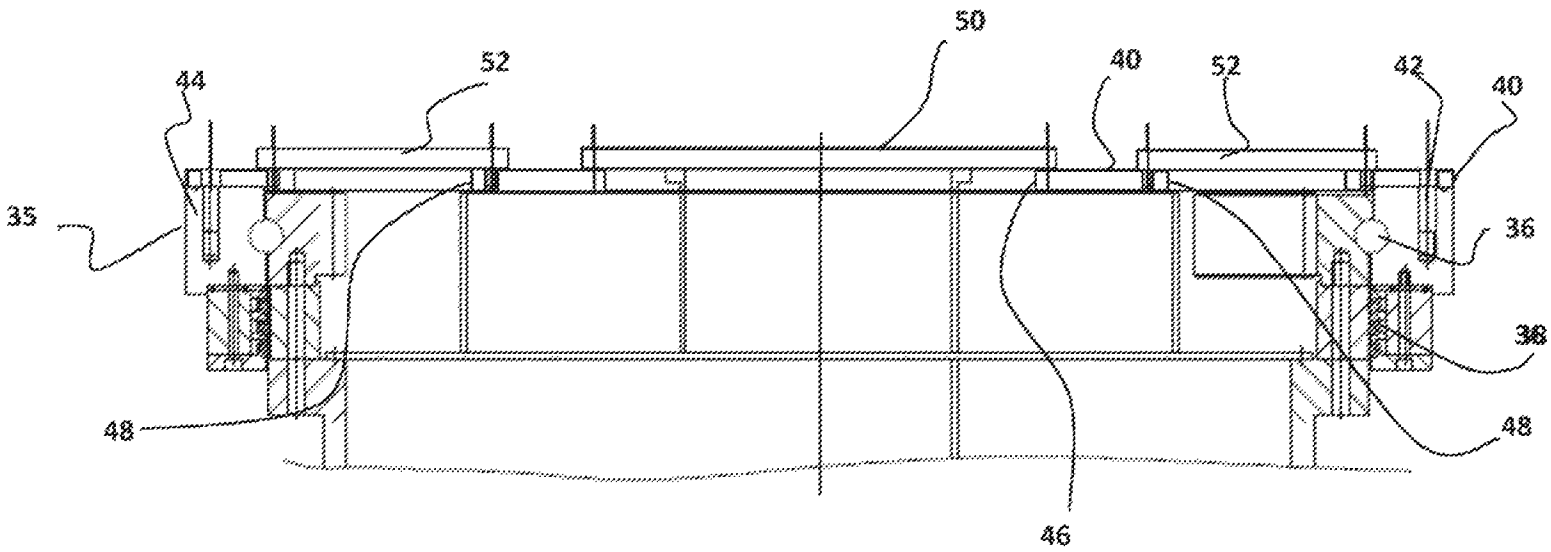
FIG. 3 shows an upper portion of a propulsion unit side portion of an arrangement according to the invention.

The FIG. 3 shows an upper portion of a propulsion unit side portion of an arrangement according to an embodiment of the invention. The propulsion unit 2 is prefabricated outside the ship and it will be transported under the hull and lifted into the right position using 3-point lifting with guide tubes and wires, for example as shown in the FIG. 8. The propulsion unit 2 also includes a lower part 35 of the steering module, which is fixed to the upper part 4 of the propulsion unit. As well-known in the art there is slewing bearings 36 and watertight seals 38 surrounding the lower part 35 of the steering module and the upper part 4 of the propulsion unit 2, respectively. The prefabricated propulsion unit is covered by a flange plate 40, which is fixed by bolts 42 to the outer ring 44 of the slewing bearing. The flange plate 40 comprises a third opening 46 in the middle part of the flange plate 40 and fourth openings 48 on the outer ring side of the flange plate 40.

The third opening 46 is covered by a third watertight cover 50, which is bolted water tightly to the flange plate 40. The fourth openings 48 are covered by a fourth watertight covers 52, which are bolted water tightly to the flange plate 40.

The third opening 46 has the same horizontal location as the first opening 24, when the propulsion unit 2 has been installed to the hull 6. In other words if the third and first openings have round periphery, their midpoints coincide. Similarly the fourth openings 48 has the same horizontal location as the second openings 28, when the propulsion unit 2 has been installed to the hull 6. In other words as the fourth and second openings have round periphery, their midpoints coincide.

The third opening for electric cables, pipes and cooling air channels and the fourth openings for steering motor assemblies 30 are blanked water tightly by blanking flanges, i.e. by the third and the fourth watertight covers. Dummy pinion 39 with one teeth is integrated to one blanking plate of steering motor assemblies 30 flange in order to lock the gear ring.

The grease channels (not shown) of the slewing bearing are plugged with watertight plugs.

The diameter of the first opening 24 is slightly larger than the diameter of the third cover 50. Likewise the diameter of the second openings 28 are slightly larger than the diameter of the fourth covers 52. The clearance range between the opening and the cover introduced to the opening is quite small as the guiding is controlled by the lifting and guiding elements. When the propulsion unit 2 has been located and lifted (FIG. 4 and FIG. 8) towards the aperture 16 in the hull 6 of the ship, propulsion unit 2 is guided so that the third cover 50 is led into the first opening 24 and the fourth watertight covers 52 are led into the second openings 28.

Figure 8:
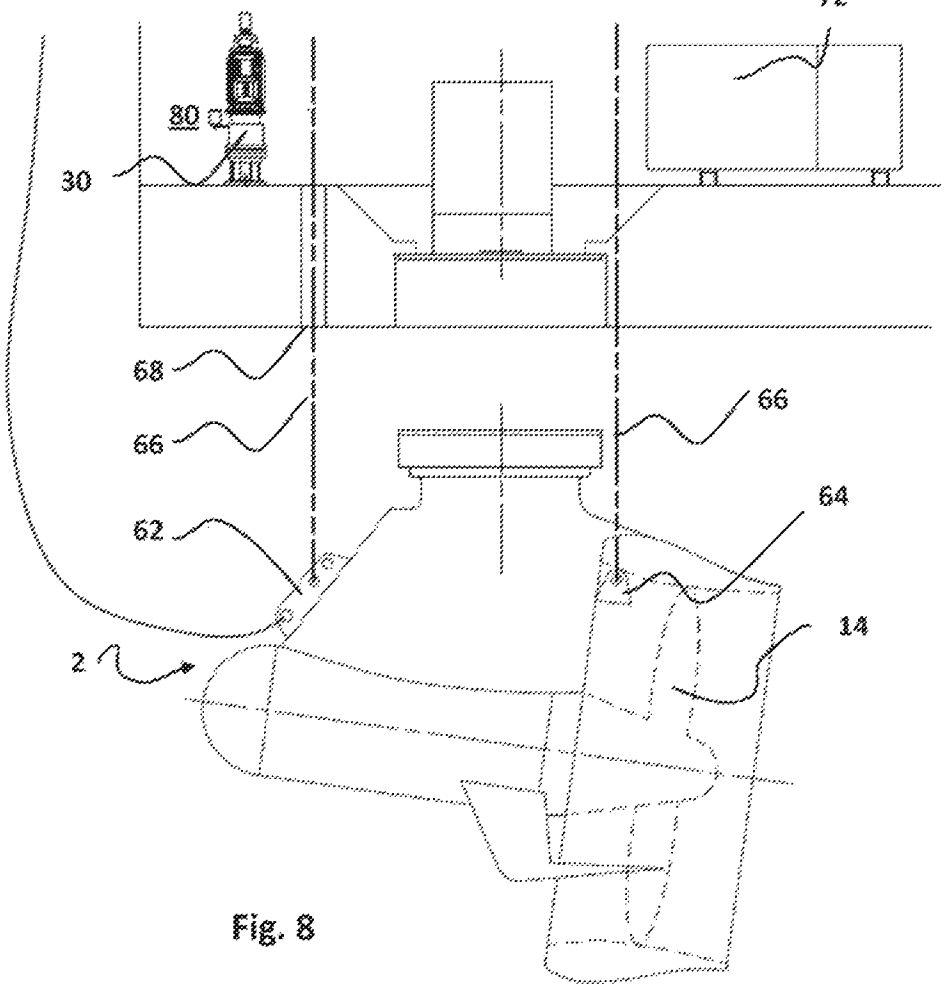
FIG. 8 shows an embodiment of a method when installing or dismounting the propulsion unit.

The FIG. 8 shows the method for installing and dismounting the propulsion unit 2. The propulsion unit 2 comprises one lifting lug 62 on the front side of the propulsion unit and two lifting lugs 64 on the aft side of the propulsion unit 2. As well known in the art the propulsion unit 2 is lifted with three lifting wires 66 using the hoisting means (not shown) located inside the hull 6. In order to position the propulsion unit the lifting wires 66 are guided by the tubes 68 that go through the structure of the hull. During the lifting of the propulsion unit 2, the steering motor 30 is positioned so that there is enough room for the lifting wires and for the operating of the hoisting means. Likewise the cooling devices 72 are disconnected from the slip sing unit.

The third and fourth watertight covers are propulsion unit-side watertight covers. The watertight plugs in the holes 21 and holes 42 are replaced with connection bolts 54, which will fix the propulsion unit 2 to the hull 6. Accordingly, watertight plugs or short connection bolts of upper part of steering module are replaced with connection bolts 54. As long as the propulsion unit 2 has been installed and fixed to the hull 6, the first and second watertight covers bolted to the frame plate as well as the third and the fourth watertight covers bolted to the flange plate 40 are still in place shown in FIG. 5.

Figure 6:
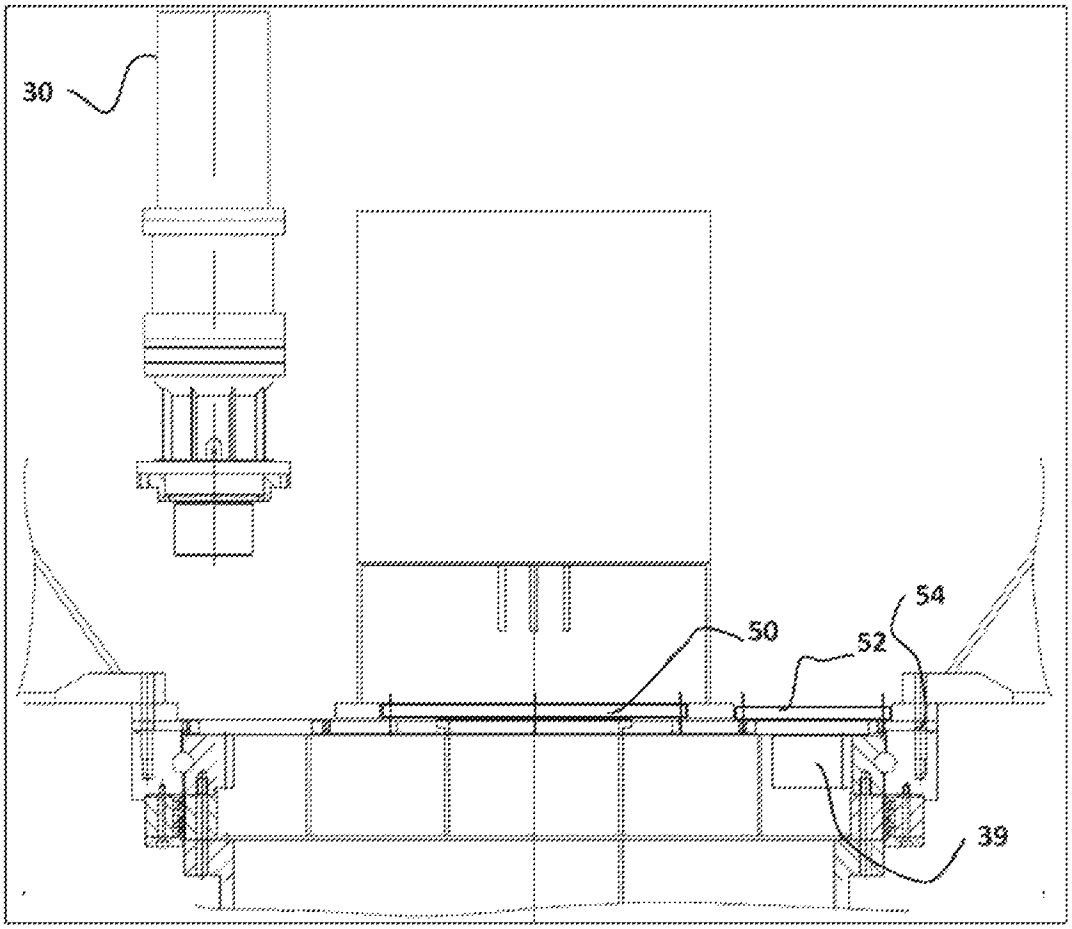
FIG. 6 shows the arrangement according to the invention ready for installing the steering motor.
Figure 7:
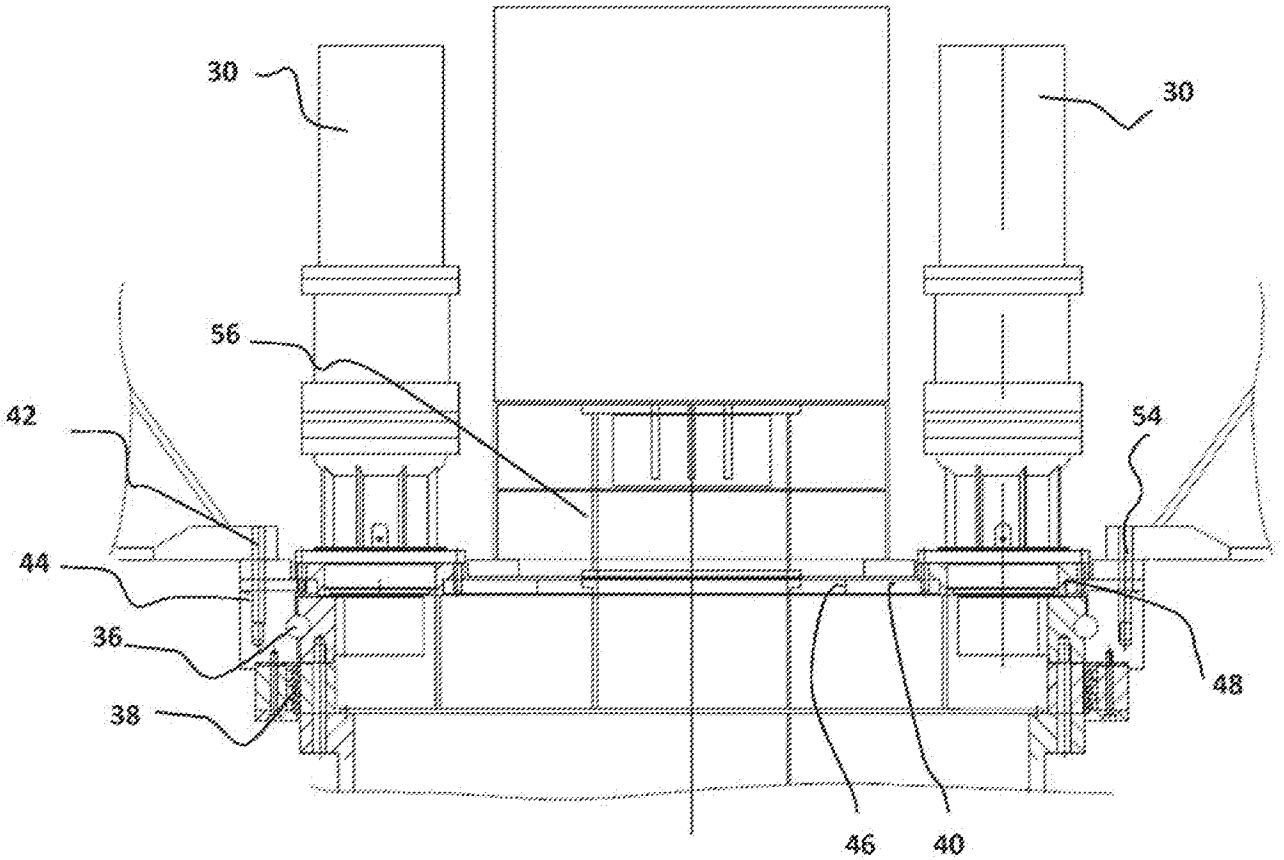
FIG. 7 shows the installed arrangement according to the invention.

The next phase of installing the propulsion unit to the hull of the ship is to dismount the watertight covers covering all the openings. First the blanking plates are removed from the upper part of the steering module. After this one of the fourth covers is removed thus revealing the gearing in the upper part of the propulsion unit. The first steering motor and planet wheel is mounted to the upper part of the propulsion unit whereas the other of the fourth covers having dummy pinion 39 is still in bolted to the upper part of the propulsion unit to prevent rotation of propulsion unit 2 (FIG. 6).

After the first steering motor has been installed the last cover, i.e. the other fourth cover is detached and removed, and the second steering motor will be installed. If there are more than two steering motors with gear, the latest steering motor to be installed is the one with dummy pinion 39 and its blank plate will removed after the other steering motors have been installed.

When the second cover covering the midpoint of the propulsion unit has been removed the slip ring unit is coupled to the propulsion unit electric cables. In addition pipe connections are made between upper and lower parts. Further the torque tube 56 is installed and fixed between the slip ring unit and the lower part, i.e. propulsion unit 2 in order to fix the slip ring unit to rotate with the propulsion unit.

The FIG. 9*a* shows a cross-section side-view of the propulsion unit when installed. The steering motor assemblies 30 have been transferred after installation procedure to their operating locations. The cooling devices 72 are connected to the slip ring unit by the cooling channel 70. During the installation procedure the steering motor assemblies 30 and the cooling channel 70 are stored in the nearby space 80 where the covers are stored.

The FIG. 9*b* shows a cross-section axial view of the propulsion unit when installed.

The first to fourth watertight covers, which are named as blanking plates, are made of steel or other strong and resistant material having basically the characteristics as material used in the hull of the ship. The thickness of the covers are rated for the circumstances prevailing under the sea level in the depth of the bottom of the hull. The thickness of the covers also is dimensioned so that the covers located one upon the other during installation have sufficient space. Thus the thickness of the removable third cover is smaller than the thickness of the frame plate as the third cover is introduced into the opening in the frame plate 18.

The watertight covers need riot be totally even through their total cross section have to fulfil the rated requirements described in the paragraph above. Thus the covers may have strengthening projections or even slight curvature. Preferably, the side of the cover facing to the seawater is even. The circumferences of the covers have a plurality of holes for the fixing bolts.

The propulsion unit 2 shown in FIG. 1 is an electric propulsion unit, where the motor driving the propeller locates in the lower part of the propulsion unit. The propulsion unit also may be a mechanical thruster, whereby the driving motor is s inside the hull and the power is transmitted via shafts and gears to propeller. In case of mechanical thruster the slip ring unit is replaced with upper gear or vertical shaft of electric motor and electric propulsion unit is replaced with mechanical thruster. In this case torque tube is not needed but vertical shaft of mechanical thruster is connected to vertical shaft of upper gear or vertical shaft of electric motor.

In a so-called L-drive the propulsion unit comprises a vertical shaft rotated by motor above it and a first bevel gear and horizontal shaft locating in the lower part of the propulsion unit. The motor may locate in the upper part of the propulsion unit or above the propulsion unit inside the hull of the ship.

In a so-called Z-drive the propulsion unit comprises a vertical shaft rotated by a second bevel gear above it and a first bevel gear and horizontal shaft locating in the lower part of the propulsion unit. The second bevel gear is connected to the shaft of a motor locating inside the hull of the ship.

When installing the propulsion unit with mechanical thruster the arrangement comprises an equipment to connect the transmission element to attach a vertical shaft of the propulsion unit to a vertical shaft above the propulsion unit.

It will be obvious to a person skilled in the art that, as the technology advances, the inventive concept can be implemented in various ways. The invention and its embodiments are not limited to the examples described above but may vary within the scope of the claims.

The invention claimed is:

1. An arrangement for installing a propulsion unit to a hull of a ship, wherein the propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperture in a bottom of the hull where to the propulsion unit is installed, wherein that the arrangement comprises a frame plate with openings attached to the hull to cover the aperture, a plurality of watertight covers covering openings in the frame plate and a plurality of watertight covers attachable to the top of the upper part of the propulsion unit to cover openings on the top of the upper part of the propulsion unit, wherein the arrangement comprises a removable hull-side cover covering at least one opening in the frame plate under it, and at least one removable cover attachable to the propulsion unit covering one opening under the at least one removable cover and facing the opening in the frame plate, and wherein the removable hull-side cover and the at least one removable cover are bolted from a hull-side.

2. The arrangement according to claim 1, wherein the arrangement comprises the frame plate watertightly attached to the hull covering the aperture, a first cover is attached to the frame plate covering a first opening therein, second covers are attached to the frame plate covering second openings therein, a flange plate is attachable to the top of upper part of the propulsion unit, a third cover is attached to the flange plate covering to a third opening therein, fourth covers are attached to the flange plate covering fourth openings therein.

3. The arrangement according to claim 2, wherein the first cover, the second covers, the third cover and the fourth covers are removable and transportable to a space inside the hull.

4. The arrangement according to claim 2, wherein the propulsion unit further comprises an electric motor rotating a propeller.

5. The arrangement according to claim 3, wherein the propulsion unit further comprises a lower part of steering module and an upper part of the steering module is installed inside the hull.

6. The arrangement according to claim 3, wherein the propulsion unit further comprises an electric motor rotating a propeller.

7. The arrangement according to claim 3, wherein the arrangement further comprises a pinion to lock the lower part of the steering module.

8. The arrangement according to claim 1, wherein the propulsion unit further comprises an electric motor rotating a propeller.

9. The arrangement according to claim 8, wherein the propulsion unit further comprises a lower part of steering module and an upper part of the steering module is installed inside the hull.

10. The arrangement according to claim 1, wherein the propulsion unit further comprises a vertical shaft rotated by a motor above the vertical shaft and a first bevel gear and horizontal shaft locating in the lower part of the propulsion unit.

11. The arrangement according to claim 1, wherein the propulsion unit further comprises a vertical shaft rotated by a second bevel gear above the vertical shaft and a first bevel gear and horizontal shaft locating in the lower part of the propulsion unit.

12. An arrangement according to claim 1, wherein the first opening is in a midpoint of the frame plate.

13. A method for installing a propulsion unit to a hull of a ship, wherein the propulsion unit comprises an upper part of the propulsion unit attachable to the hull of the ship and a lower part of the propulsion unit where to a propeller shaft is rotatably supported, and the upper part of the propulsion unit having flanges to attach the flanges tightly to the hull, and wherein there is an aperture in a bottom of the hull where to the propulsion unit is installed, wherein the method comprises a step of attaching a frame plate with openings to the hull to cover the aperture, steps of installing a plurality of watertight covers covering openings in the frame plate and of installing a plurality of watertight covers covering openings on the top of the upper part of the propulsion unit, wherein at least one removable hull-side cover covering at least one opening in the frame plate is faced to at least one removable propulsion unit side cover covering the opening under it, and wherein the at least one removable hull-side cover and the at least one removable propulsion unit side cover are bolted from a hull-side.

14. A method according to claim 13, wherein the method further comprises steps attaching the frame plate is attached to the hull covering the aperture, attaching a first cover to the frame plate covering a first opening therein, attaching second covers to the frame plate covering second openings therein, attaching a flange plate to the top of upper part of the propulsion unit, attaching a third cover to the flange plate covering a third opening therein, attaching fourth covers to the flange plate covering fourth openings therein, transporting and lifting the propulsion unit to close the hull fixing the propulsion unit to the hull, removing the first cover and the second covers, removing the third cover and the fourth covers, installing a steering motor and gear, connecting a slip ring unit and a torque tube.

15. The method according to claim 14, wherein the method further comprises a step of transporting the removed covers to a space inside the hull.

16. The method according to claim 13, wherein that the method further comprises a step of transporting the removed covers to a space inside the hull.

* * * * *